US005242326A

United States Patent [19]

Dexter

[11] Patent Number: 5,242,326

[45] Date of Patent: Sep. 7, 1993

[54] CONTINUOUS FEED FORMS FOR DEMAND PRINTERS

[76] Inventor: William P. Dexter, 3325 International Dr., P.O. Box 81429, Mobile, Ala. 36689-1429

[21] Appl. No.: 712,143

[22] Filed: Jun. 6, 1991

[51] Int. Cl.[5] ..... B42D 1/00

[52] U.S. Cl. ..... 462/2; 281/2

[58] Field of Search ..... 283/101, 105; 462/2, 462/10, 13, 25, 26, 29, 31, 32, 36, 37, 40, 46; 281/2, 5

[56] References Cited

U.S. PATENT DOCUMENTS

| | | | |
|---|---|---|---|
| Re. 33,616 | 6/1991 | Welsch | 462/26 R |
| 3,824,907 | 7/1974 | Gärtner . | |
| 3,993,814 | 11/1976 | Cavender | 283/101 X |
| 4,000,916 | 1/1977 | Lucas . | |
| 4,108,352 | 8/1978 | Peschke . | |
| 4,121,857 | 10/1978 | Halse . | |
| 4,140,335 | 2/1979 | Paulson et al. . | |
| 4,168,851 | 9/1979 | Halse . | |
| 4,171,831 | 10/1979 | Robinson | 462/26 |
| 4,217,162 | 8/1980 | Glanz et al. . | |
| 4,217,384 | 8/1980 | Shnug . | |
| 4,230,514 | 10/1980 | Becker et al. . | |
| 4,248,919 | 2/1981 | Davis . | |
| 4,357,380 | 11/1982 | Schnug . | |
| 4,508,365 | 4/1985 | Hawkes . | |
| 4,637,635 | 1/1987 | Levine | 285/105 X |
| 4,824,142 | 4/1989 | Dossche . | |
| 4,865,669 | 9/1989 | Schmidt | 462/86 X |
| 4,869,530 | 9/1989 | Minor . | |
| 4,890,862 | 1/1990 | Buchholz | 462/26 X |
| 4,927,179 | 5/1990 | Ehret et al. | 285/105 X |
| 4,995,642 | 2/1991 | Justak et al. | 283/105 |

*Primary Examiner*—Timothy V. Eley
*Assistant Examiner*—Willmon Fridie, Jr.
*Attorney, Agent, or Firm*—Gregory Friedlander

[57] ABSTRACT

Forms of an overlay attached to a carrier sheet by way of glue lines or cross web glue running perpendicular to the carrier margin holes. The overlay is produced without margins or the margins of the overlay form sheets are removed so that the forms may be separated from the carrier while the carrier remains attached to a recessed print face or tractor feed. The glue lines or cross web glue running perpendicular to the carrier margin holes are isolated from the remainder of the form by stub lines on either side of the glue lines or cross web glue. Alternatively, two glue lines may be used and a single stub provided between the two glue lines.

9 Claims, 4 Drawing Sheets

CONTINUOUS FEED FORMS FOR DEMAND PRINTERS

BACKGROUND OF THE INVENTION

1. Field of the Invention

This invention applies to continuous forms having multiple copies.

More particularly, the invention applies to continuous forms having removable webbing for separation of the individual sheets making up the multiple copies.

2. Prior Art

The prior art shows the use of continuous forms having margins, said margins having printer feel holes. These feed holes are utilized by the printer tractor feed to guide the continuous forms through the printer.

The prior art also shows the use of stubs running along either side of the continuous form along the entire length of the continuous forms to allow separations of the margins from the remainder of the form so that there are removable margins. The prior art shows that these removable margins with feed holes running along the vertical length of the form.

The prior art also shows the use of a press in order to punch holes in the margins and to insert a stub. The stub allows for the margins to be separated by tearing along the stub. The overlays are made up of the sheets which make up the multiple copies of the continuous form.

The prior art also shows attachment through the use of horizontally placed spot glue to hold items such as envelopes or letterhead onto continuous feed forms, so called "shingling" attachments and the use of horizontal cross-web glue lines to make envelopes.

In the prior art, except for the "shingling" concept described above for the use of attaching items to a page, only the application of glue and stubs and tear-off lines along the vertical axis for separation of individual forms of the overlay is taught.

The problem associated with the prior art addressed by this patent is that certain printers have a print line as well as the tractor feed recessed in the printer, making it difficult to remove a form just printed. Oftentimes the tractor gates, that portion of the printer with teeth to grip the feed holes, are in the way of removing the individual form insofar as the tractor gates are holding a used form at the same time that an unused form is sitting ready below it in the printer. The unused form needs to, in turn, go through the tractor gates. Often the entire next form or a long length of the continuous overlay is wasted to accomplish the desired result.

The present invention provides a stub perpendicular to the continuous margins having tractor feed holes on a carrier sheet. The overlays are designed without margins so as not to engage directly the tractor gates by virtue of having no margins or having margins less than the margins of the bottom carrier sheet. The carrier sheets, below the overlay sheets, have a margin and holes to engage the tractor feeds.

Typically, the overlay is made up of the individual forms attached together to be continuous. The overlay is between three-quarters of an inch and one and one-quarter inch narrower than the carrier sheet. The carrier would have a typical weight of twenty pounds or twenty-four pounds, dependent on the number of parts or overlays involved in the overall set and the weight of the paper of each.

In order to keep the overlays in order and in contact with the carrier, the overlays would be fixed in place, as by glue, along the lines more or less perpendicular to the vertical series of carrier holes.

Additionally, the use of a removable type glue such as that available on POST-IT TM note pads, could be utilized in order to provide additional or alternate holding power.

Additional stubs could be added along the vertical axis which would allow the invention to be more firmly glued to the carrier without departing from the inventive concept taught herein.

There are several methods which would allow for the attachment of the overlay sheets to the carrier. Among these are the following (all known in the common art):

1. A disk punch wherein one or more partial disks are punched out of the paper, with a portion of the disk not being punched out, which portion is pushed through the set and flattened vertically against the back of the set in order to hold them together;
2. A keyhole lock punch which is the same as a disk punch except a larger area is pushed back, locking the set in place;
3. Plastic heated flattened stitches which are staples which hold the form (these staples are only about one-quarter of an inch wide);
4. A perforation lock which is one or more vertical slits and which are curved to drive the slit formed through and crimp the paper down (these are currently used exclusively along the vertical margins);
5. A vertical crimp or hook lock, which is commonly used to hold margin alignment of papers along a tractor feed.
6. A cross-web glue line (the most ideal method in this invention).

GENERAL DISCUSSION OF THE INVENTION

In the preferred embodiment, the invention would be prepared largely in two parts:

1. A carrier sheet having carrier holes punched for use with a pin type tractor feed. This carrier sheet would be a continuous roll having vertical strips of holes running on either side for engaging the tractor feed.
2. In addition, there would be overlay sheets which would also be a continuous form of a length more or less equal to the length of the carrier.

The carrier sheet could be perforated at every fold length or not perforated according to the intended use. The overlay would be perforated (as with stubs) along its width in order to allow the various forms to be separated from one another. In the preferred embodiment, two closely spaced perforations forming a separator would separate one form from the next in the otherwise continuous overlay.

Between each form of the overlay runs a separator which comprises lines of glue running between two narrowly-spaced perforations or stubs. Two forms in series may be viewed as a forward form and a following form, the following form being that form immediately following the forward form. After printing, the form is separated at the top from the top separator. Then the form is separated at the bottom from the bottom separator. The bottom separator stays in place, glued to the carrier. The following form is held to the carrier at its top by this "bottom separator" of the previous form which is, in fact, the "top separator" of this following form.

This glue would be at the "top" of each form running between two stubs which would, preferably, form a separator approximately one-half inch wide.

Alternatively, the bottom of this separator which is attached to the carrier could be attached with "peel-apart" or spot glue for easy removal from the carrier sheet so that the separator would be removed from the carrier sheet with the form.

In this alternative, the parts may be spot glued. This would eliminate the need for one of the two horizontal perforations or stubs as described in the preferred embodiment.

The cross-web glue technique is old in the art and can be found on free-form insert mailer type processes which avoid "tenting" problems. Cross-web gluing is not used in the prior art for the same purpose as shown in the present invention.

Other fastening or connecting means as discussed above, such as plastic staple-type paper crimps, would provide similar results.

The form construction is accomplished by fastening the top of each form of an overlay to a carrier sheet. Each overlay would be in on or more plies. All of the ply sheets of the overlay would be narrower than the carrier by a width sufficient to keep the overlay clear of the tractor feed teeth and the tractor gate cover, depending on the model and make of the printer.

With the use of vertical crimps or perforation locks, the user would not have to remove the margins and no "tenting" would be necessary.

The printing of the forms is done before cutting. Then the rolls are removed. The forms are then put on a high speed collator equipped for cross-web gluing. The forms are then glued, perforated and the margins are removed from all but the carrier and fan folded (if desired).

The overlay could have margins which feed through the tractor feed as long as the margins of the overlay would tear free from the carrier sheet without tearing the margins of the carrier sheet without departing from the inventive concept embodied herein.

An improvement of the preferred embodiment over the prior art is that glued wide margin type products (e.g. Moore SPEEDIWEB TM) which require the operator to tear down the margins of each side and then tear across the bottom perforations is eliminated. This is expensive to produce and oftentimes the operator has problems, since he or she cannot get his or her hand down to cover and tear the margins or bottom perforations away evenly.

After the form is printed, the overlay would be lifted away from the carrier sheet at the top of the form and all the pages would be torn at a slight angle up and away from the perforations at the bottom of the form. If it is desired that the carrier not be separated, the perforations on all but the carrier sheet would be made easy to tear.

This carrier sheet, if not utilized as an extra copy, may be used as an audit trail, or if desired, the bottom part could be recycled. It may remain continuous.

This device is used on demand type printers where the tractor feed or covers of the printers make normal continuous forms difficult or impossible to remove from the printer as individual sets without wasting the following form in the machine. This would improve over the prior art by saving paper.

Another improvement is that this will eliminate the difficulty associated with removing margins down the side of sets recessed in the printer.

There are a number of other improvements over the prior art. Among these are the simplicity of use. The current products require a longer spacer, an extra length of all the parts inserted, to throw the form far enough out of the print mechanism and tractor feeds so that the form can be torn off (usually 5 to 6 inches). This is expensive because, for example, an 11-inch form becomes a 17-inch form, having two to six plies (or sheets) of paper that have to be torn off and thrown away. This is cumbersome, wasteful and expensive. Using the present invention, at most only the last carrier sheet and the separator between the horizontal stubs would need to be torn off and thrown away. Since the carrier could be kept continuous, it would not result in a number of separate sheets of paper but could instead be recycled as a single continuous sheet. If the separator is removed, the carrier sheet could be used directly as continuous feed typewriter paper.

An additional improvement is over shingled sets. A shingled set is manufactured as a unit, such as a multiple-part snap-out form, and then glued by its stub to a continuous carrier. This is more expensive to produce. Since the only fastening is by a stub at the top it is not a continuous form. The shingled set often hangs up or jams while traveling through the printer. Also, the bottom of the form is loose, allowing it to catch, jam or pull loose from the carrier while being printed.

The present invention provides for a continuous form and also for a form that is fastened at the top and bottom of each horizontal stub or perforation.

The form can be produced for virtually any size on high-speed collating operations, since slicers could remove the margins of all but the carrier part and then allow for the carrier part to feed through the tractor feed of a printer.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DISCUSSION OF THE PREFERRED EMBODIMENT(S)

Figure 3:
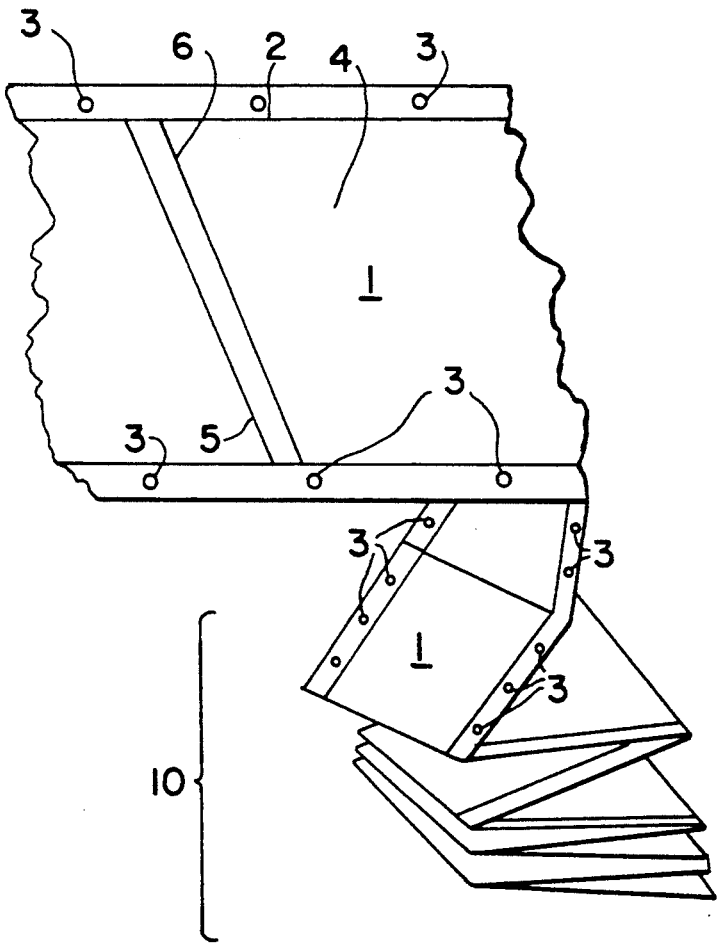
FIG. 3 is a perspective view of the invention shown in FIG. 1, showing the product as assembled and showing the individual components as assembled.

As can best be seen by reference to FIG. 3, the invention comprises a series of forms 1 joined to make a continuous roll shown generally as 10. The length of this pack 10 is governed by the desired number of forms to be put in a case. In FIG. 3, the pack is shown fan folded for shipping. FIG. 3 shows the corners of three layers of the overlay 13, 14, and 15 lifted back for clarity.

Figure 1:
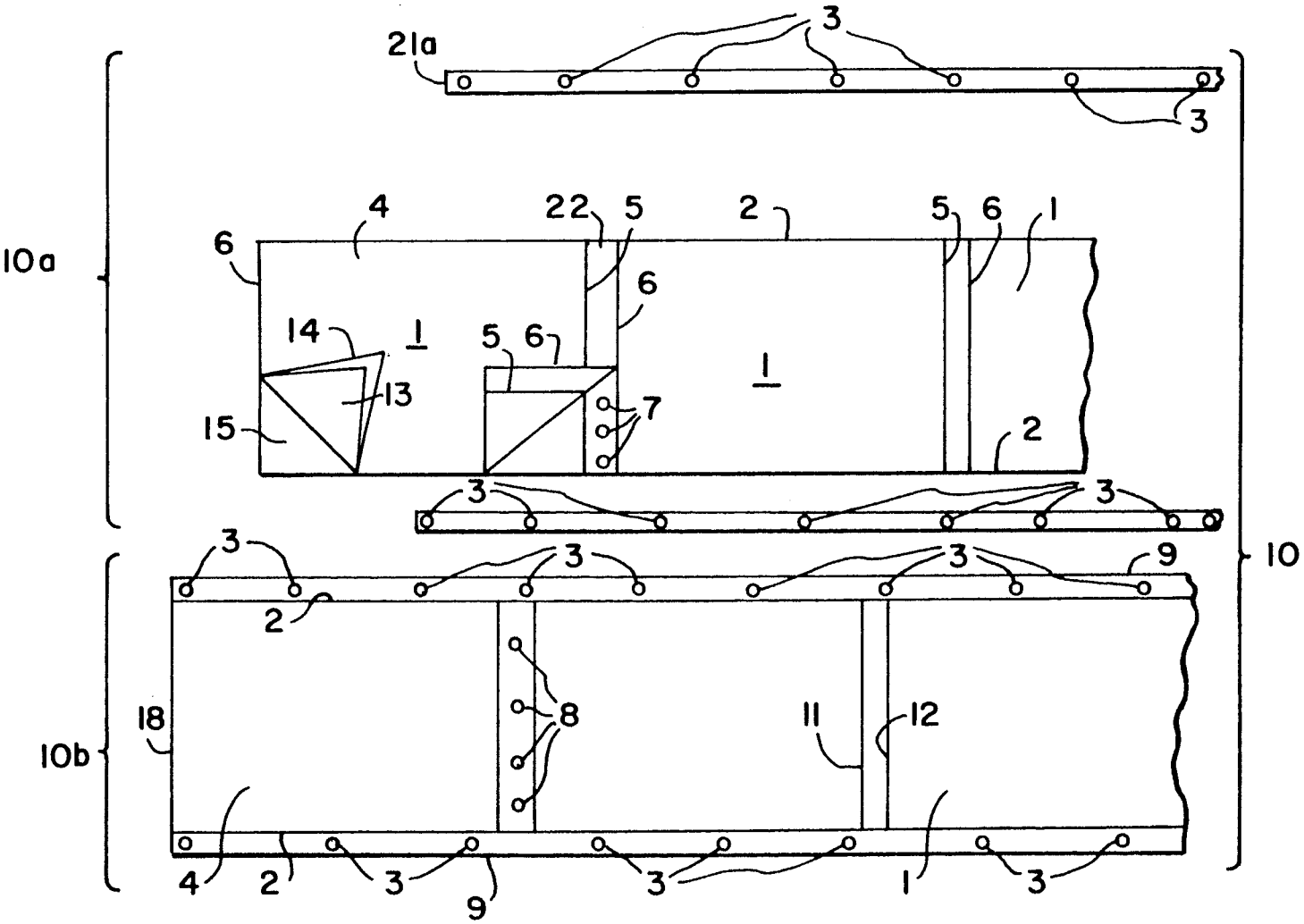
FIG. 1 is an exploded view of the invention showing a section of the overlay exploded from a section of the carrier sheet.

As can best be seen by reference to FIG. 1, each of the forms is preferably manufactured in two different parts. Part One is a carrier sheet shown generally as carrier 10*b* which is equivalent to a continuous sheet of paper and may be of any length. This carrier 10*b* of the roll need not be perforated to have the individual sections separated, as will become apparent from the description of the remainder of the ream that follows.

There is a margin 21*b* shown generally as the area between the inner edge 2 of the margin 21*b* and the outer edge 9 of the margin 21*b*. As is standard in the industry, this margin 21*b* has holes 3 which serve to engage the tractor feed of a printer (not shown). The tractor feed move the forms through the printer at a speed which they are sought to be moved forward.

Also shown on the carrier 10*b* are carrier front stub 11 and carrier rear stub 12. Only one of these stubs 11–12 is necessary for folding. The two would be added as stubs 11 and 12 for the carrier to be fan folded and for the carrier sections to be separated from the continuous carrier as copies are made in the preferred embodiment.

The second part of the roll 10 is a continuous overlay shown generally as 10*a*. This overlay 10*a* is similar to those in the prior art to the extent that it consists of multiple layers shown as the bottom layer 15, one or more middle layers 13, and a top layer 14.

It should be noted that the overlay need only have a single layer 15. The number of layers is solely dependent on the needs of the user.

It should also be noted that the major improvement between this invention and the prior art lies in part in the removal of one or more of the overlay margins 21*a* of this overlay 10*a*. Instead, the invention comprises an overlay 10*a* between the two inner edges 2 of the margin 21*b* of the carrier sheet 10*b*.

In the prior art, a common tractor feed mechanism, margins with holes matching those of the carrier, in the overlay 10*a* allowed for the overlay 10*a* to be properly fed through the tractor feed.

In the preferred embodiment, the tractor feed margins 21*a* on the overlay 10*a* are removed from the overlay 10*a* prior to assembly. The overlay margins 21*a* are removed during the production process. Alternatively, the overlay margins 21*a* need never be generated at all. Typically, they must be removed after the overlay 10*a* is attached to the carrier 10*b* since the holes 3 would be needed to hold the overlay 10*a* in place during the printing and collating process until removed by the collator after gluing the overlay 10*a* to the carrier 10*b* as described in more detail below.

The bottom sheet 15 of the overlay 10*a* is held to the carrier sheet 10*b* by a first connecting means 8, which is perpendicular to the row of carrier holes 3. In the preferred embodiment, this first connecting means 8 would be a series of glue spots 8. In this way, the overlay 10*a* is glued in place to the carrier sheet 10*b*.

In order to allow the individual sheets or forms 1 of the overlay 10*a* to be separated from the carrier 10*b*, two stub lines, front stub line 5 and rear stub line 6 are added. The separator 22 between the stub lines 5 and 6 lies over a second connecting means 7 as described in more detail below.

The stub lines 5 and 6 pass through all of the layers of the overlay 10*a* so that the entire set of layers 13, 14 and 15 forming one form 1 of the overlay 10*a* may be separated from the roll 10 of overlay forms 1 which follow by tearing along the stub lines 5 and 6. In the preferred embodiment, the second connecting means 7 and separator 22 would remain on the carrier 1 after the first of the series of forms, first form 4, is removed. In this case, in order to separate the first form 4 from the continuous roll of overlays, it would be torn across the top at 6, which represents the point at which the rear stub 6 of the front most separator 22 is located and then the f first form 4 would be torn along its bottom at stub 5, which is where the rear stub 5 for the following separator 22 is located.

The separator 22, being between inner margin edges 11 and 12 in the carrier 10*b*, is the only wasted paper from the overlay 10*a*.

The distance between and location of stubs 5 and 6 of the overlay 10*a* is the same as that of at least one of the stubs 11 and 12 of the carrier sheet 10*b* to allow for proper fan folding.

The carrier 10*b* need not be an imaged sheet, and the bottom layer of the overlay 15 need not be carbon paper. There is no need to have an imprint on the carrier sheet. The reason why an imprint on the carrier sheet might be important is to generate a record of the transactions or to provide an additional copy. The reason one would not want that record would be because of the increase in cost to have the additional image made.

Figure 2:
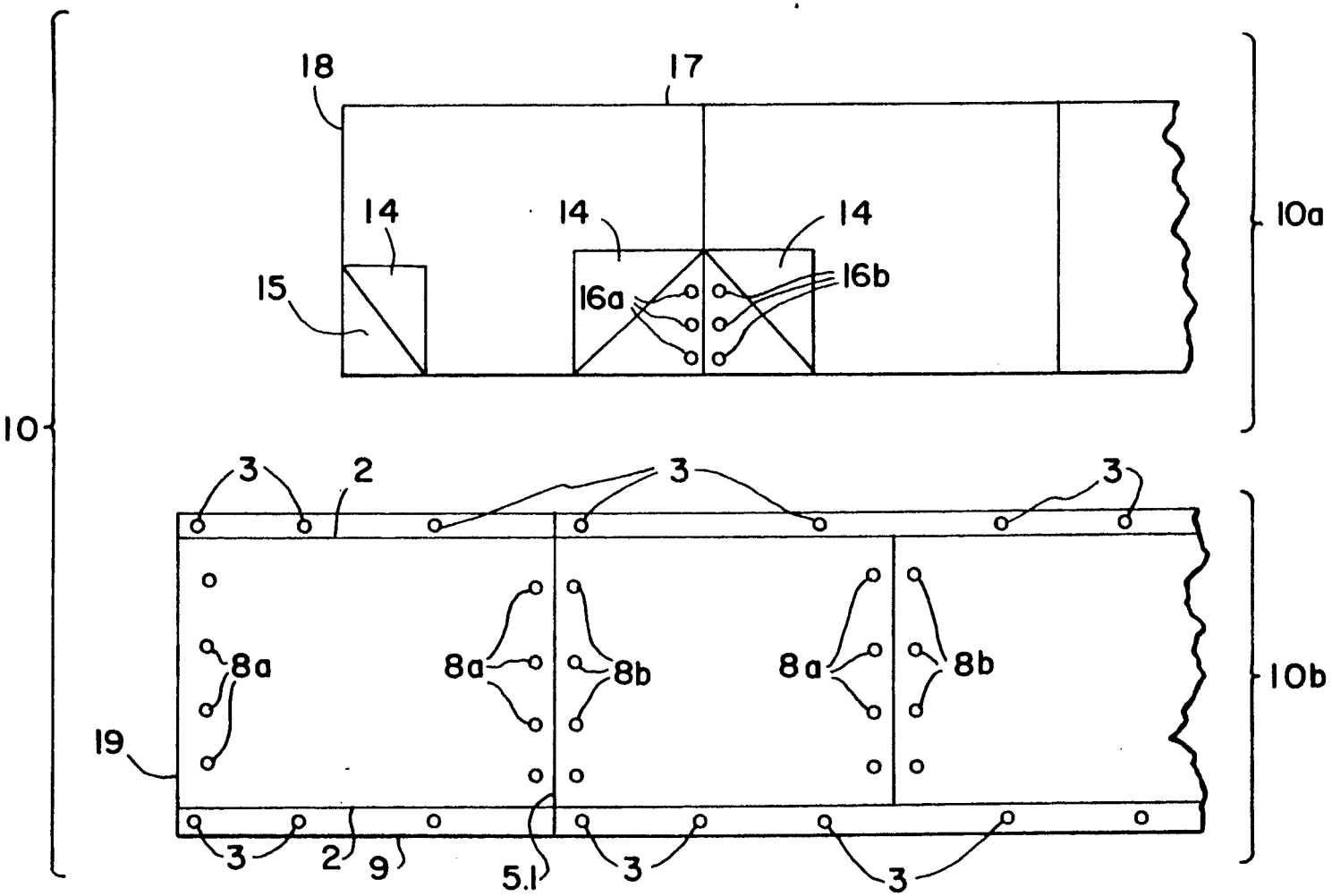
FIG. 2 is an exploded view of an alternative embodiment of the invention.

Although the preferred embodiment envisions two stubs 5 and 6, there can, in fact, be a single stub, 6.1, in which case two separate glue lines 16*a* and 16*b* would need to be shown, as can be seen in FIG. 2.

In FIG. 2, instead of having one row 16 of glue spots, there are two rows 16*a* and 16*b*. In addition, there is only one stub 17, which separates the bottom 6 of one form from the top 5 of the next form.

In addition, since there is no separator wasted when the connecting means 7 is removed, there need to be two lines of glue shown as 8*a* and 8*b* on the carrier in order to allow the following overlay sheets to be held to the carrier after the preceding overlay sheet is removed.

In FIG. 2, there is shown only a bottom sheet 15 and a top sheet 14 for the overlay. The number of copies of each form is discretionary.

FIG. 2 shows that the very front 18 of the first sheet 4 would connect with the very front of the carrier 19 in the preferred embodiment.

As can readily be seen, in the event that the fastening means 7 of FIG. 1 utilizes spot glue for the second connecting means, and also assuming that the carrier uses spot glue for the first connecting means 8, it can readily be seen that one of the two stub lines 5 or 6 is only optional and may be left out completely. In this case, either the top of the form or the bottom of the form would have the spot glue or other fastening residue, but this is not necessarily a problem for all applications and all fastening means. It may be desirable to produce forms with POST-IT( TM ) type glue for these applications.

It should be noted that if the overlay is produced with margins 21*a* or originally, one or more of these margins 21*a* may remain in place for the separator if the separator 20 is to remain attached to the carrier 10*b*. This would add to the attachment of the overlay without interfering with the invention.

Figure 4:
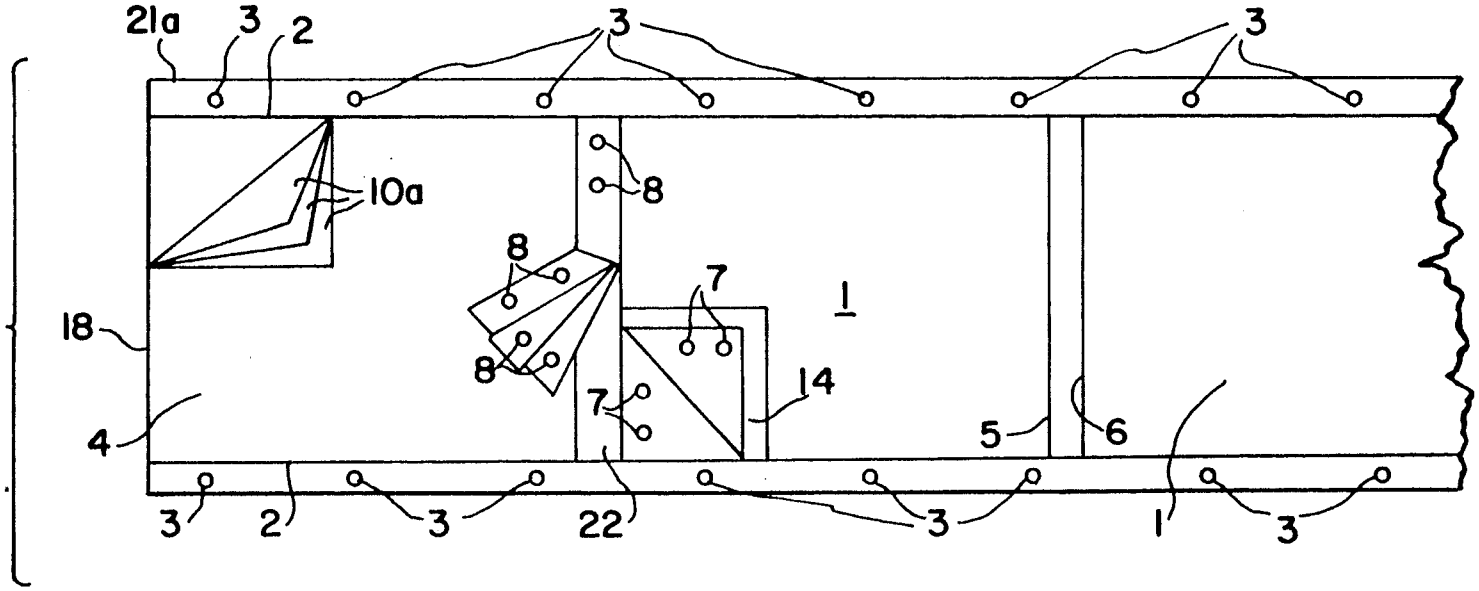
FIG. 4 is a perspective view of the product shown in FIG. 3 with the addition of narrow, non-interfering stubs and glue lines running along the vertical length of the roll.

As can best been seen by reference to FIG. 4, at least one alternative margin 20 may be added to one or more layers of the overlay 10*a*. Preferably these alternate margins 20 are added to either side of the overlay.

In the preferred method of adding this alternate margin 20 passes through all the form layers and is held together by glue lines 23*a* below alternate margin 20 on the overlay. This alternate margin 20 is held to the carrier by alternate glue line 23*b*. Each sheet of the overlay is held together at the alternate margin 20 by alternate glue line 23*b*.

Glue lines 23*a* and 23*b* may be any form of connecting means and can be referred to as overlay alternate connecting means 23*a* and carrier alternate connecting means 23*b*.

The purpose of the alternate margin 20 is in order to allow for non-interfering margins which hold the overlay 10*a* to the carrier 10*b*. Non-interfering refers to the fact that these margins do not engage the tractor feed.

However, original overlay margins 21, made so as to engage the tractor feeds, could be left in place where the separators 22 are found and removed from the forms 1 without departing from the inventive concept embodied herein. This may be desirable to have the forms held in place more securly with the preferred embodiment of the invention. Similarly, for the embodiment of FIG. 1 or FIG. 2, even if occasional forms 1 had the margins 21 or a portion thereof in place, the invention disclosed herein would still be effected for those forms wherein these margins 21 were removed.

An alternative margin stub 24 may be added to allow the alternate margin 20 to be separated from the overlay form 1.

PROCESS

As can be seen, the product described above can be performed by virtue of a process which is not disclosed by the prior art and consists of the steps of:

Step 1: Imprinting a continuous overlay 10*a* of continuous forms 1.

Step 2: Imprinting on a continuous carrier sheet 10*b*.

Step 3: Adding a separator means 22 between individual forms 1 of the overlay 10*a*.

Step 4: Adding a separator means 22 between individual sheets of the carrier sheet 10*b*.

Step 5: Attaching the layers 13, 14 and 15 of the continuous overlay 10*a* to one another by a second connecting means 7 along at least one of said forms.

Step 6: Attaching the overlay 10*a* to the continuous carrier 10*b* by means of a first attaching means 8; said first attaching means being below said separator means 22 along at least one of said forms.

Step 7: Repeating steps 3–6 for the entire overlay so that the entire overlay is connected to the carrier sheet.

Step 8: Removing the margins of the continuous overlay 10*a*.

The order of these steps may be varied without departing from the inventive concept embodied herein. The steps may be more fully described.

The process for manufacturing the described product comprises the step of imprinting the forms 1 of the overlay 10*a*. This is done using methods known in the art as step 1. This first step is not necessary if only "blank forms", that is forms without any pre-printed matter, are to be generated.

Similarly, the next step is also known in the art and is the imprinting of matter on the carrier sheet, step 2.

Step 3 is providing a separating means preferably a set of stubs 5 and 6 between the forms 1. This separating means comprises, in the preferred embodiment, two stubs. In the alternate embodiment shown in FIG. 2, it comprises a single stub.

Step 4 is providing a second separating means 11–12 on the carrier, preferably a set of stubs 11 and 12, attaching a continuous overlay to continuous carrier by way of a first connecting means. Step 5 is attaching the layers 13, 14 and 15 of the overlay 10*a* to one another by a connecting means 7, preferably a spot glue line 7. This spot glue line 7 would consist of a series of glue spots 7 perpendicular to the direction to travel of the continuous strip 21.

Step 6 would be attaching the carrier to the overlay by means of a second connecting means 8 which in the preferred embodiment would be crossweb glue 8 so that the overlay 10*a* would be attached to the carrier 10*b* in such a way that the second connecting means 8 was more or less above the first connecting means 7 and running parallel thereto.

It can be seen that the connecting means 7 consists of several layers each having glue lines over each layer of a form the first connecting means 8. It is obvious that each of the layers 7 may have a different glue or other connecting means or other portions of connecting means 7.

It should also be obvious that connecting means 8 may consist of one or more different types of connecting means used separately or together without departing from the inventive concept thereof.

Step 7 is repeating steps 3 through 8 along the entire length of the overlay so that the entire overlay is attached to the carrier sheet.

The order of the steps may be varied to be similar to different process considerations without departing from the inventive concepts.

It is also obvious that, given the inventive concept embodied herein, that when the overlay is attached to the carrier mechanism, a single sheet at a time, the printing could be done at this same time, one sheet at a time. In the attachment process, all sheets may be attached as follows: the carrier would be matched with a single overlay sheet and glued thereto. then a second sheet of the overlay would be glued to the first sheet of the overlay, and then the third sheet of the overlay (in the case of a three-sheet overlay) would be attached to the top of the second overlay.

We claim:

1. A continuous feed form for use with the demand printers having tractor feeds comprising:

a. A carrier having at least one margin to engage the tractor feeds of the demand printers;

b. An overlay of continuous forms having a leading edge wherein the leading edge is connected by a first connecting means only at the leading end of the form and said overlay being sufficient narrow so as to not to engage the tractor feeds of a printer and wherein each of the forms of the overlay are separated by a front stub line running between the forms of the overlay separating the forms.

2. Invention of claim 1 wherein the first connecting means comprises at least one spot glue line running between the carrier and the overlay only at the front end of the form leading edge.

3. The invention of claim 1 wherein the overlay further comprises a rear stud line parallel to the front stub line and wherein the first connecting means lies between the front stub line and the rear stub line so that the space between the front stub line and a rear stub line encloses the first connecting means so that when forms are separated they do not contain the residue from the first connecting means.

4. The invention of claim 1 wherein the overlay further comprises:

a. at least one stub line having a front side and a rear side;

b. a front connecting means holding the overlay to the carrier sheet on the front side of the stub line;

c. a rear connecting means holding the overlay to the carrier on the rear side of the stub line;

d. a front stub line means located between the first connecting means and the rear connecting means for allowing the form connected by the front connecting means to be separated from the form held by the rear connecting means.

5. The continuous form of claim 1 wherein the overlay consist of at least two layers above the carrier so only the bottom layer contacts the carrier, each of said layers not connected to the carrier being connected to the layer below by way of an overlay connecting means for attaching one overlay layer to the layer above.

6. The continuous feed form of claim 1 wherein the overlay further comprises:

a. At least two layers, each layer having a top and bottom;

b. A second connecting means for holding the top of one layers to the bottom of the layer immediately above it also that he layer are held together by means of this second connecting means.

7. The continuous feed form of claim 6 wherein the first connecting means is located on the bottom layer of the of the overlay and wherein the second connecting means lies directly above the first connecting means.

8. The continuous form of claim 7 wherein the first connecting means run more or less perpendicular to the direction of travel of the form throughout the tractor feed.

9. The continuous form of claim 8 wherein the overlay further comprises a front stub line parallel and adjacent to the second connecting means and a second stub line on the following form parallel and adjacent to the second connecting means so that the area between one form and the following form comprises a separator so that the individual forms may be separated form the second connecting means and any following forms.

* * * * *